US008480516B2

(12) United States Patent
Cheng et al.

(10) Patent No.: US 8,480,516 B2
(45) Date of Patent: Jul. 9, 2013

(54) METHODS FOR ENCOURAGING USE OF GREENHOUSE GAS REDUCING GOLF BALLS

(75) Inventors: Chia-Chyi Cheng, Portland, OR (US); Chien-Hsin Chou, Yun-Lin Hsien (TW); Chen-Tai Liu, Yun-Lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 5 days.

(21) Appl. No.: 13/033,428

(22) Filed: Feb. 23, 2011

(65) Prior Publication Data

US 2012/0094785 A1 Apr. 19, 2012

(51) Int. Cl.
*A63B 69/36* (2006.01)

(52) U.S. Cl.
USPC ..... 473/409

(58) Field of Classification Search
USPC ..... 473/409
See application file for complete search history.

(56) References Cited

U.S. PATENT DOCUMENTS

| | | | |
|---|---|---|---|
| 4,305,851 | A | 12/1981 | Tominaga et al. |
| 4,528,228 | A | 7/1985 | Clevenger |
| 4,857,368 | A | 8/1989 | Klein |
| 4,955,966 | A | 9/1990 | Yuki et al. |
| 5,371,113 | A | 12/1994 | Ward, III et al. |
| 5,461,109 | A | 10/1995 | Blair et al. |
| 5,817,728 | A | 10/1998 | Higuchi et al. |
| 5,820,488 | A | 10/1998 | Sullivan et al. |
| 5,823,889 | A | 10/1998 | Aoyama |
| 5,984,806 | A | 11/1999 | Sullivan et al. |
| 6,042,638 | A | 3/2000 | Mallow et al. |
| 6,103,787 | A | 8/2000 | Rajagopalan et al. |
| 6,435,146 | B1 | 8/2002 | Kantola et al. |
| 6,435,986 | B1 | 8/2002 | Wu et al. |
| 6,451,423 | B1 | 9/2002 | Armat et al. |
| 6,632,146 | B1 | 10/2003 | Halko et al. |
| 6,767,294 | B2 | 7/2004 | Nesbitt |
| 6,794,472 | B2 | 9/2004 | Harris et al. |
| 6,808,461 | B2 | 10/2004 | Harris et al. |
| 7,083,532 | B2 | 8/2006 | Ohama |
| 7,179,856 | B2 | 2/2007 | Park et al. |

(Continued)

FOREIGN PATENT DOCUMENTS

| | | |
|---|---|---|
| JP | 55059825 | 5/1980 |
| JP | 2002219193 A | 8/2002 |
| NL | 1030771 | 6/2007 |
| WO | 9831542 | 7/1998 |

OTHER PUBLICATIONS

International Search Report and Written Opinion in PCT application No. PCT/US2012/026167, mailed on Sep. 28, 2012.

(Continued)

*Primary Examiner* — Raeann Gorden
(74) *Attorney, Agent, or Firm* — Plumsea Law Group, LLC

(57) ABSTRACT

This disclosure provides methods for encouraging golfers and other users to use greenhouse gas reducing golf balls. Greenhouse gas reducing golf balls may include carbon dioxide absorbents, in order that the golf ball may reduce atmospheric carbon dioxide levels to aid in alleviating global warming. The methods may include determining a degree of usage of a used greenhouse gas reducing golf ball, and awarding a reward to a user based on the degree of usage. The methods thereby promote the use of certain greenhouse gas reducing golf balls instead of conventional golf balls, and encourages the reuse of those greenhouse gas reducing golf balls.

18 Claims, 9 Drawing Sheets

U.S. PATENT DOCUMENTS

| | | | |
|---|---|---|---|
| 7,182,702 | B2 | 2/2007 | Hogge et al. |
| 7,226,961 | B2 | 6/2007 | Park et al. |
| 7,393,289 | B2 | 7/2008 | Egashira et al. |
| 7,465,482 | B2 | 12/2008 | Yamazaki et al. |
| 7,614,965 | B2 | 11/2009 | Shindo et al. |
| 7,682,662 | B2 | 3/2010 | Sasaki |
| 7,727,309 | B2 | 6/2010 | Robertson et al. |
| 2003/0069082 | A1 | 4/2003 | Sullivan |
| 2004/0266555 | A1 | 12/2004 | Park et al. |
| 2008/0085783 | A1 | 4/2008 | Isogawa et al. |
| 2009/0082137 | A1 | 3/2009 | Okabe |
| 2010/0000852 | A1 | 1/2010 | Curtin et al. |
| 2010/0056305 | A1 | 3/2010 | Hebert et al. |
| 2010/0210745 | A1 | 8/2010 | McDaniel et al. |
| 2010/0248862 | A1 | 9/2010 | Sullivan et al. |
| 2012/0046126 | A1 * | 2/2012 | Chou et al. ..... 473/374 |

OTHER PUBLICATIONS

International Search Report and Written Opinion in PCT application No. PCT/US2012/026168, mailed on Sep. 28, 2012.

Office Action in U.S. Appl. No. 13/033,407 mailed on Jan. 17, 2012.

Final Office Action in U.S. Appl. No. 13/033,407 mailed on Jun. 28, 2012.

Final Office Action for U.S. Appl. No. 13/033,407 mailed on Dec. 27, 2012.

* cited by examiner

METHODS FOR ENCOURAGING USE OF GREENHOUSE GAS REDUCING GOLF BALLS

BACKGROUND

The present disclosure relates generally to the field of golf balls. Specifically, the present disclosure relates to methods for encouraging golfers and other users to use greenhouse gas reducing golf balls, namely golf balls containing carbon dioxide absorbents.

The game of golf is an increasingly popular sport at both the amateur and professional levels. Unfortunately, the game of golf may be considered by some to be less than ideally greenhouse gas reducing. The manufacture, transportation, maintenance, and use of golf balls and golf equipment may have a high environmental impact. Namely, the manufacture of golfing equipment may be energy intensive, and may require materials that are not necessary "green." Global warming in particular is considered to be an important environmental concern. A wide range of industries are undertaking measures to reduce their emissions of the green house gases that contribute to global warming.

In the golf ball industry, various technologies have sought to reduce green house gas emissions through increased energy efficiency. However, few technologies have enabled the golf ball itself to play a role in the fight against global warming.

U.S. Patent Application Publication No. 2009/0082137 to Okabe discusses how golf balls might be made more "carbon neutral" through the use of non-petroleum based polymer materials. Specifically, the use of non-petroleum based materials in golf balls may prevent an increase in the amount of atmospheric carbon dioxide, as renewable materials do not add any new carbon dioxide to the atmosphere whereas petroleum products release previously sequestered carbon dioxide. As a result of this prevention of an increase in carbon dioxide levels, this golf ball may thereby help prevent global warming. However this golf ball could at best be only carbon neutral, and is not capable of reducing the total amount of carbon dioxide in the atmosphere.

Methods of encouraging environmentally friendly activity, such as recycling, by golfers are generally known in the art. U.S. Patent Application Publication No. 2010/0056305 to Hebert et al., the disclosure of which is hereby incorporated in its entirety, discloses incentives for recycling golf balls. However, the methods disclosed therein do not relate to greenhouse gas reducing golf balls.

Therefore, there is a need in the art for a golf ball that helps reduce greenhouse gases, for example, carbon dioxide, and methods for encouraging their use.

SUMMARY

Generally, this disclosure provides golf balls containing carbon dioxide absorbents. The carbon dioxide absorbents may absorb carbon dioxide from the atmosphere upon use by a golfer, so that the act of golfing may help combat global warming.

In one aspect, this disclosure provides a method of encouraging use of a greenhouse gas reducing golf ball by a golfer, the method comprising steps of (a) receiving a used greenhouse gas reducing golf ball from a user, the used greenhouse gas reducing golf ball comprising a core; an intermediate layer substantially surrounding the core, the intermediate layer being substantially impermeable to water; a cover layer substantially surrounding the intermediate layer; a carbon dioxide absorbent selected from the group consisting of alkaline hydroxides, alkaline oxides, alkali hydroxides, alkali oxides, and mixtures thereof; the carbon dioxide absorbent being encapsulated within a plurality of microcapsules; the plurality of microcapsules being frangible, such that at least one microcapsule of the plurality of microcapsules breaks as a result of a force applied by a golf club face to the greenhouse gas reducing golf ball during a drive, thereby exposing the carbon dioxide absorbent therein to atmospheric carbon dioxide; the plurality of microcapsules being comprised of a material that is substantially impermeable to carbon dioxide; the plurality of microcapsules being dispersed within a polymer matrix, the polymer matrix constituting a structural component of the greenhouse gas reducing golf ball; (b) determining a degree of usage of the used greenhouse gas reducing golf ball based on at least one physical property of the used greenhouse gas reducing golf ball; and (c) awarding a reward to the user based on the degree of usage.

In another aspect, this disclosure provides a method of encouraging use of a greenhouse gas reducing golf ball by a golfer, the method comprising steps of: (a) providing a substantially new greenhouse gas reducing golf ball to a golfer, the greenhouse gas reducing golf ball comprising a carbon dioxide absorbent selected from the group consisting of alkaline hydroxides, alkaline oxides, alkali hydroxides, alkali oxides, and mixtures thereof; the carbon dioxide absorbent being dispersed within a polymer matrix, the polymer matrix constituting a structural component of the golf ball; and a trace element; (b) receiving a used greenhouse gas reducing golf ball from the golfer, the used greenhouse gas reducing golf ball corresponding to the substantially new greenhouse gas reducing golf ball after use; (c) identifying the used greenhouse gas reducing golf ball by comparing information associated with the trace element to information in a database; (d) obtaining a default value of at least one physical property from the database; (e) measuring the at least one physical property of the used greenhouse gas reducing golf ball to obtain a post-use value of the at least one physical property; (f) comparing the default value to the post-use value to determine a degree of usage; and (g) awarding a reward to the golfer based on the degree of usage.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
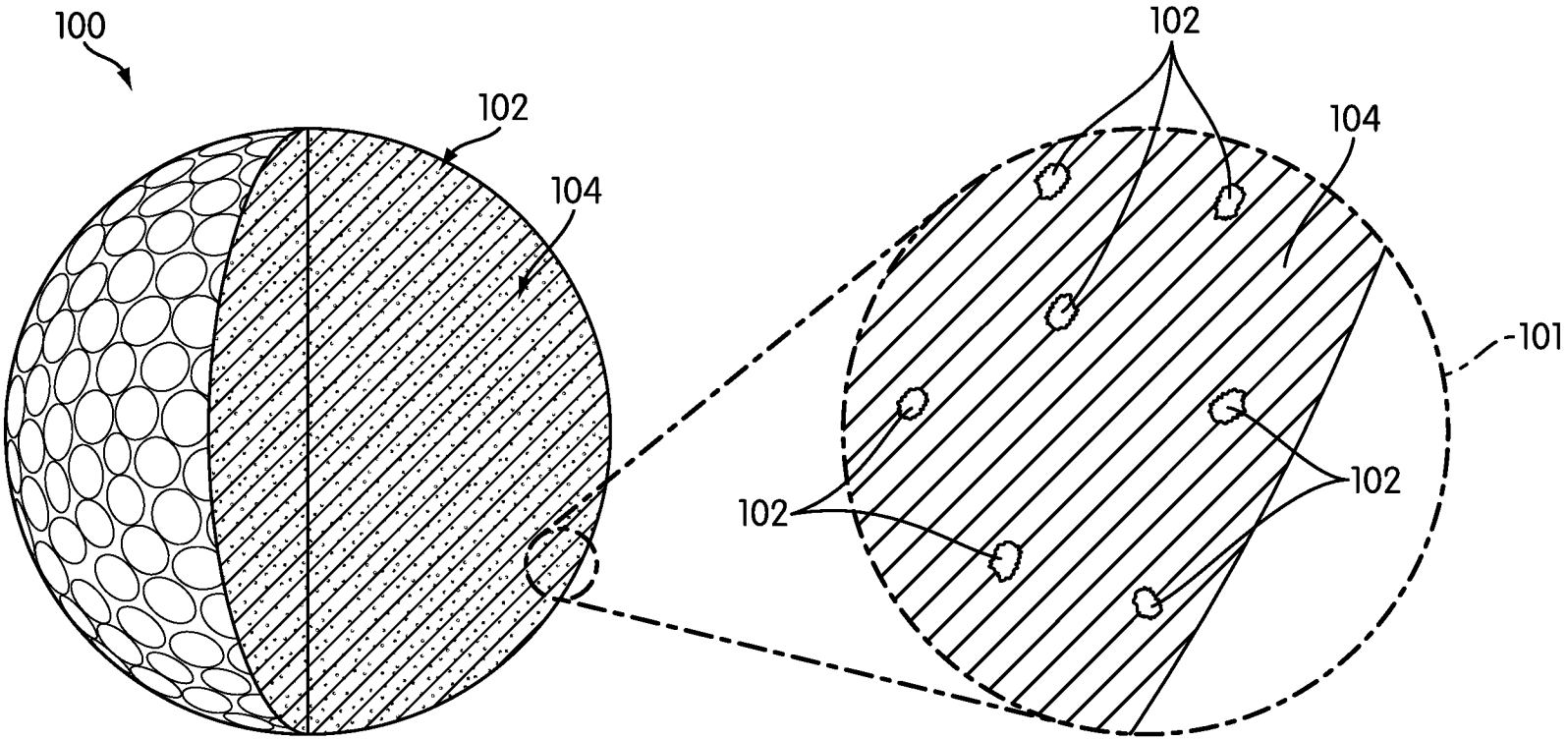
FIG. 1 shows an embodiment of a one-piece golf ball including carbon dioxide absorbents.

This disclosure relates generally to golf balls that include a carbon dioxide absorbent therein, and methods of using these golf balls. The carbon dioxide absorbent may absorb atmospheric carbon dioxide so as to reduce the total amount of green house gasses in the atmosphere, thereby helping to alleviate global warming. The use of such a golf ball including a carbon dioxide absorbent makes the act of playing golf a greenhouse gas reducing activity.

Generally, the carbon dioxide absorbent may be any composition that is capable of reacting with atmospheric carbon dioxide so as to form reaction products that include less carbon dioxide. In some embodiments, the carbon dioxide absorbent may be a base. The base may react with the carbon dioxide in an acid/base reaction to form a salt and water. In other embodiments, the carbon dioxide absorbent may be activated carbon, or an amine gas sweetening composition, for example. A wide variety of carbon dioxide absorbents are known the gas-scrubbing field.

In some embodiments, the carbon dioxide absorbent may be a strong base such as alkaline hydroxides, alkaline oxides, alkali hydroxides, alkali oxides, or mixtures thereof. Any of these compounds may generally act as the carbon dioxide absorbent, however heavier elements may have drawbacks such as price or toxicity. The chemical reaction between these hydroxides or oxides and carbon dioxide may be seen with respect to calcium hydroxide and calcium oxide, for example:

$$CaO+H_2O \rightarrow Ca(OH)_2 \qquad \text{Reaction (1)}$$

$$Ca(OH)_2+CO_2 \rightarrow CaCO_3+H_2O \qquad \text{Reaction (2)}$$

In other words, alkaline oxides or alkali oxides such as calcium oxide may absorb and react with water in the atmosphere to form alkaline hydroxides or alkali hydroxides, respectively, such as calcium hydroxide (Reaction 1). Then, the alkaline hydroxide or alkali hydroxide such as calcium hydroxide may react with atmospheric carbon dioxide to form a metal salt such as calcium carbonate and water (Reaction 2). As is known in the art, these particular calcium based carbon dioxide absorbents may also be referred to as lime. Namely, calcium oxide may also be referred to as burnt lime or quicklime, while calcium hydroxide may also be referred to as slaked lime or slack lime.

As mentioned, oxides may require the presence of water in order to react in situ to form hydroxides, which then react with carbon dioxide. However, these oxides are themselves considered carbon dioxide absorbents as that phrase is used herein because the presence of water in the atmosphere will generally be sufficient for Reaction 1 to proceed to at least some degree.

Alternatively, an alkaline hydroxide or alkali hydroxide such as sodium hydroxide may be used without also including an oxide. For example, sodium hydroxide may be used as the carbon dioxide absorbent, and may react with carbon dioxide according to the formula:

$$2NaOH+CO_2 \rightarrow Na_2CO_3+H_2O \qquad \text{Reaction (3)}$$

In other words, two sodium hydroxide molecules react with one carbon dioxide molecule to form sodium carbonate and water. As is known in the art, sodium hydroxide may also be referred to as lye or caustic soda.

In particular embodiments, calcium oxide (CaO), calcium hydroxide ($Ca(OH)_2$), sodium hydroxide (NaOH), lithium hydroxide (LiOH), and potassium hydroxide (KOH), and mixtures thereof may be used as the carbon dioxide absorbent. These strong metallic bases are readily available at economically feasible rates and react effectively with atmospheric carbon dioxide.

Generally, a salt may be formed as a result of the reaction between the carbon dioxide absorbent and the atmospheric carbon dioxide. The presence of this salt may cause the golf ball to increase in weight. This increase in weight may be largely negligible, or the increase in weight may be sufficient to be measurable and affect the play characteristics of the golf ball. The United States Golf Association (USGA) official Rules of Golf require that a regulation golf ball weigh no more than 45.93 grams. Therefore, a golf ball in accordance with this disclosure may be manufactured to weigh some amount less than 45.93, so that the golf ball may increase in weight as atmospheric carbon dioxide is absorbed. For example, a finished golf ball manufactured in accordance with this disclosure may weigh 45.5 grams before absorbing any significant amount of atmospheric carbon dioxide.

The carbon dioxide absorbent exists in the finished golf ball in a form that is capable of reacting with atmospheric carbon dioxide. Therefore, the strong metallic base must be substantially unreacted (i.e. not a salt) upon completion of manufacturing of the golf ball and first use of the golf ball by a golfer. In the golf ball manufacturing arts, compounds such as calcium oxide, calcium hydroxide, sodium hydroxide, and other strong bases are known to be used as neutralizing agents or activating agents. However, in such cases, the compound itself is not present in the final golf ball, but instead reacts with another chemical in the golf ball's composition such as an acidic polymer to form a salt. Therefore, only golf balls having the above mentioned chemicals in the final, finished composition are within the scope of this disclosure.

The carbon dioxide absorbent discussed above may be dispersed within a polymer matrix, where the polymer matrix may correspond to a structural component of the golf ball. The dispersion of carbon dioxide absorbents into a polymer matrix is discussed, for example, in U.S. Pat. No. 6,451,423 to Armat et al., the disclosure of which is hereby incorporated by reference in its entirety. Generally, in embodiments where the carbon dioxide absorbent is a solid, the carbon dioxide absorbent may be ground into fine particles or flakes. In various embodiments, the fine particles or flakes may have an number average particle size diameter of from about 0.5 μm to about 100 μm, or from about 0.5 μm to about 50 μm, or from about 0.5 μm to about 10 μm, or from about 0.5 μm to about 5 μm, or any intermediate points within these ranges.

The fine particles or flakes of carbon dioxide absorbent may then be physically intermixed with a polymer material through an extruder or other such known processing equipment, as is generally known in the art and discussed in U.S. Pat. No. 6,451,423 to Armat et al. In various embodiments, the carbon dioxide absorbent may comprise from about 1% to about 30% by weight of the polymer matrix, or from about 1% to about 20%, or from about 1% to about 10%, or from about 1% to about 5%, or any intermediate points within these ranges.

Broadly, a golf ball according to this disclosure may be of any general ball construction known in the art of manufacturing golf balls. For example, in various embodiments, the construction of the golf ball may be a one-piece ball, a two-piece ball, or a multi-piece ball.

FIG. 1 shows a first embodiment of a golf ball in accordance with this disclosure. Golf ball 100 is a one-piece ball, made of the same material 104 throughout its entirety. As is generally known in the art, material 104 used to make up the one-piece golf ball may be a synthetic rubber. Golf ball 100 also includes carbon dioxide absorbents 104. Carbon dioxide absorbents 104 may be dispersed within material 104. In other words, material 104 may be a polymer matrix within which particles of carbon dioxide absorbent 104 are dispersed. In this one-piece ball, carbon dioxide absorbents 104 may be dispersed throughout the entirety of material 104. Alternatively, in other embodiments, carbon dioxide absorbents 104 may be located (for example) in an outer region of material 104, so that atmospheric carbon dioxide may more easily penetrate into golf ball 100 and reach the carbon dioxide particles 104.

Close-up view 101 of a portion of golf ball 100, as shown in FIG. 1, shows further detail of the carbon dioxide absorbent particles 102. Carbon dioxide absorbent particles 102 may be numerous in relation to the amount of polymer matrix material 104, in order to achieve a high loading level. As mentioned above, carbon dioxide absorbent particles 102 may generally comprise from about 1% to about 30% by weight of the material 104. Also as discussed above, carbon dioxide absorbent particles 102 may have any of a variety of particle sizes ranging from an average of 0.5 μm to an average of about 100 μm.

Figure 2:
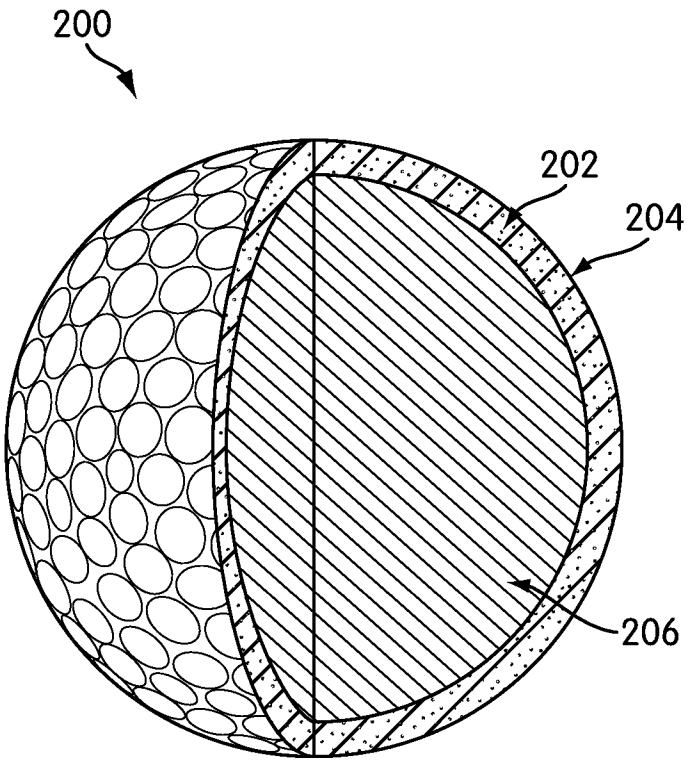
FIG. 2 shows an embodiment of a two-piece golf ball including carbon dioxide absorbents in a cover layer.

FIG. 2 shows a second embodiment of a golf ball in accordance with this disclosure. Golf ball 200 is a two-piece golf ball. Golf ball 200 therefore includes at least cover layer 204 and core 206. Cover layer 204 substantially surrounds core 206 and includes a plurality of dimples thereon. Two-piece golf ball 200 may generally be manufactured in accordance with known methods and materials for manufacturing two-piece golf balls. In the embodiment shown in FIG. 2, cover layer 204 includes carbon dioxide absorbent particles 204 dispersed therein. In order words, carbon dioxide absorbent particles 204 may be dispersed in a polymer matrix, where the polymer matrix corresponds to cover layer 204. As a result of this configuration where the carbon dioxide absorbent particles 204 are located on an outermost layer (cover layer 204), atmosphere carbon dioxide gas may easily diffuse into cover layer 204 and react with carbon dioxide absorbent particles 204.

Although the embodiment shown in FIG. 2 only includes carbon dioxide absorbent particles 204 in cover layer 204, in other embodiments core 206 may also include carbon dioxide absorbent particles 204. Alternatively, in yet other embodiments, core 206 may include carbon dioxide absorbent particles 204 while cover layer 204 may not include carbon dioxide absorbent particles 204. The carbon dioxide absorbent particles 204 may generally be located in any component of golf ball 200. The location of carbon dioxide absorbent particles 204, as well as the loading level weight percentage and particle size, may be determined according to factors such as available processing equipment, the desired reaction rate, and economic feasibility, among others.

In particular, carbon dioxide absorbent particles 204 may be in the form of as fine particles, and may be mixed with cover materials such as thermoplastic materials (for example: ionomer resin, highly neutralized acid polymer composition, polyamide resin, polyester resin, polyurethane resin) or thermoset materials (for example: polyurethane elastomers, polyamide elastomers, polyurea elastomers, diene-containing polymer, crosslinked metallocene catalyzed polyolefin, and silicone). The carbon dioxide absorbents of this invention may also be blended with other polymer as a masterbatch.

Figure 3:
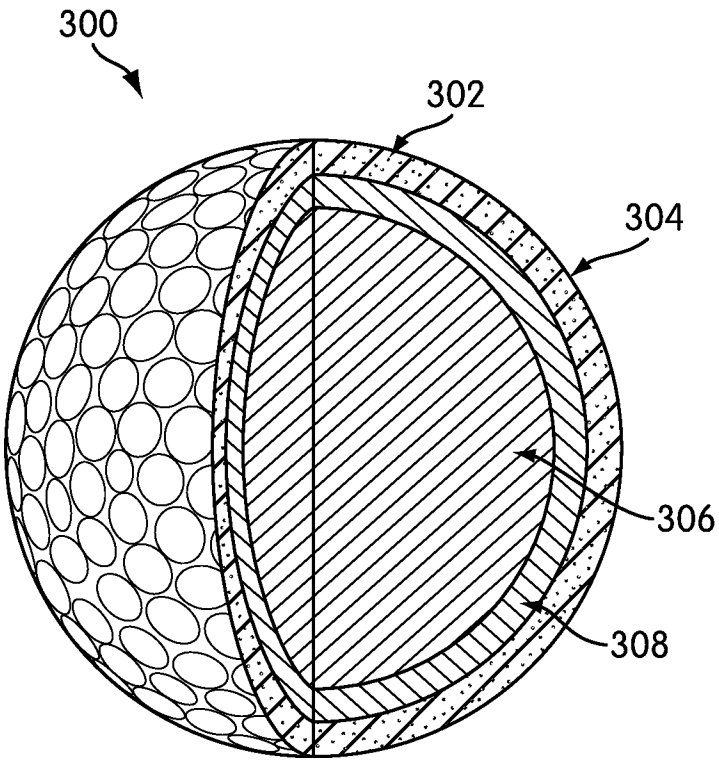
FIG. 3 shows an embodiment of a three-piece golf ball including carbon dioxide absorbents in a cover layer.

FIG. 3 shows a third embodiment of a golf ball in accordance with this disclosure. Golf ball 300 is a three-piece golf ball. Golf ball 300 includes at least core 306, intermediate layer 308 substantially surrounding core 306, and cover layer 304 substantially surrounding intermediate layer 308. Golf ball 300 may generally be manufactured in accordance with well known methods and materials for manufacturing three-piece golf balls.

In the embodiment shown in FIG. 3, golf ball 300 includes carbon dioxide absorbent particles 302 in cover layer 304. However, in other embodiments not shown, carbon dioxide absorbent particles 302 may be present in other layers of a three-piece golf ball. For example, carbon dioxide absorbent particles 302 may be present in each of core 306, intermediate layer 308 and cover layer 304; or carbon dioxide absorbent particles 302 may be present in only one of core 306, intermediate layer 308 or cover layer 304; or any combination thereof.

In particular embodiments, intermediate layer 308 may be moisture barrier layer that is substantially impermeable to water. Water is known to have adverse effects on the physical properties of the core. Specifically, the presence of water in a golf ball core disadvantageously decreases the coefficient of restitution (COR) of the golf ball. As discussed above, water is produced during the chemical reaction by which carbon dioxide gas is absorbed. Therefore, water may accumulate within the golf ball as a result of the carbon dioxide absorbance reaction. This water will tend to degrade the performance of the golf ball over time by reducing the COR. Accordingly, a moisture barrier layer may be included in the golf ball in order to isolate the core from the carbon dioxide absorbent particles.

U.S. Pat. No. 7,182,702 to Hogge, et al. discuses the problem of water degrading a golf ball core, and discloses a golf ball with a vapor barrier layer therein. The disclosure of U.S. Pat. No. 7,182,702 to Hogge, et al. is hereby incorporated by reference in its entirety. The vapor barrier layer disclosed therein may be comprised of butyl rubber, and may function to prevent reduction in the resiliency of the core due to the presence of water therein.

U.S. Pat. No. 5,820,488 to Sullivan et al. also discusses how water may adversely affect a golf ball core, and discloses a moisture barrier located between the core and cover layer. The disclosure of U.S. Pat. No. 5,820,488 to Sullivan et al. is hereby incorporated by reference in its entirety. The moisture barrier disclosed therein may be made of materials such as polyvinylidene chloride, vermiculite, or a flouridated polymer material.

In particular embodiments, intermediate layer 308 may be comprised of a hydrophobic thermoplastic polyurethane. U.S. Pat. No. 6,435,986 to Wu et al. discloses advantageous hydrophobic thermoplastic polyurethanes that may be used in golf balls. The disclosure of U.S. Pat. No. 6,435,986 to Wu et al. is hereby incorporated by reference in its entirety.

Generally, intermediate layer 308 may be comprised of any of the above-discussed materials, or other materials that are substantially impermeable to water. The selection of the particular material used as intermediate layer 308 may depend on factors such as: the degree to which the material is impermeable to water, the material's hardness, the material's resilience, and economic feasibility, among other factors.

Intermediate layer 308 may generally have a thickness of from about 0.1 mm to about 2 mm. FIG. 3 shows intermediate layer 308 as being of about the same thickness as cover layer 304. However, in other embodiments, the thickness of intermediate layer 308 may be substantially different from the thickness of cover layer 304. Thickness values are also discussed in U.S. Pat. No. 6,435,986 to Wu et al. and U.S. Pat. No. 5,820,488 to Sullivan et al. A person having ordinary skill in the art may select the thickness of the intermediate layer as may be desired for the overall construction of golf ball 300.

Figure 4:
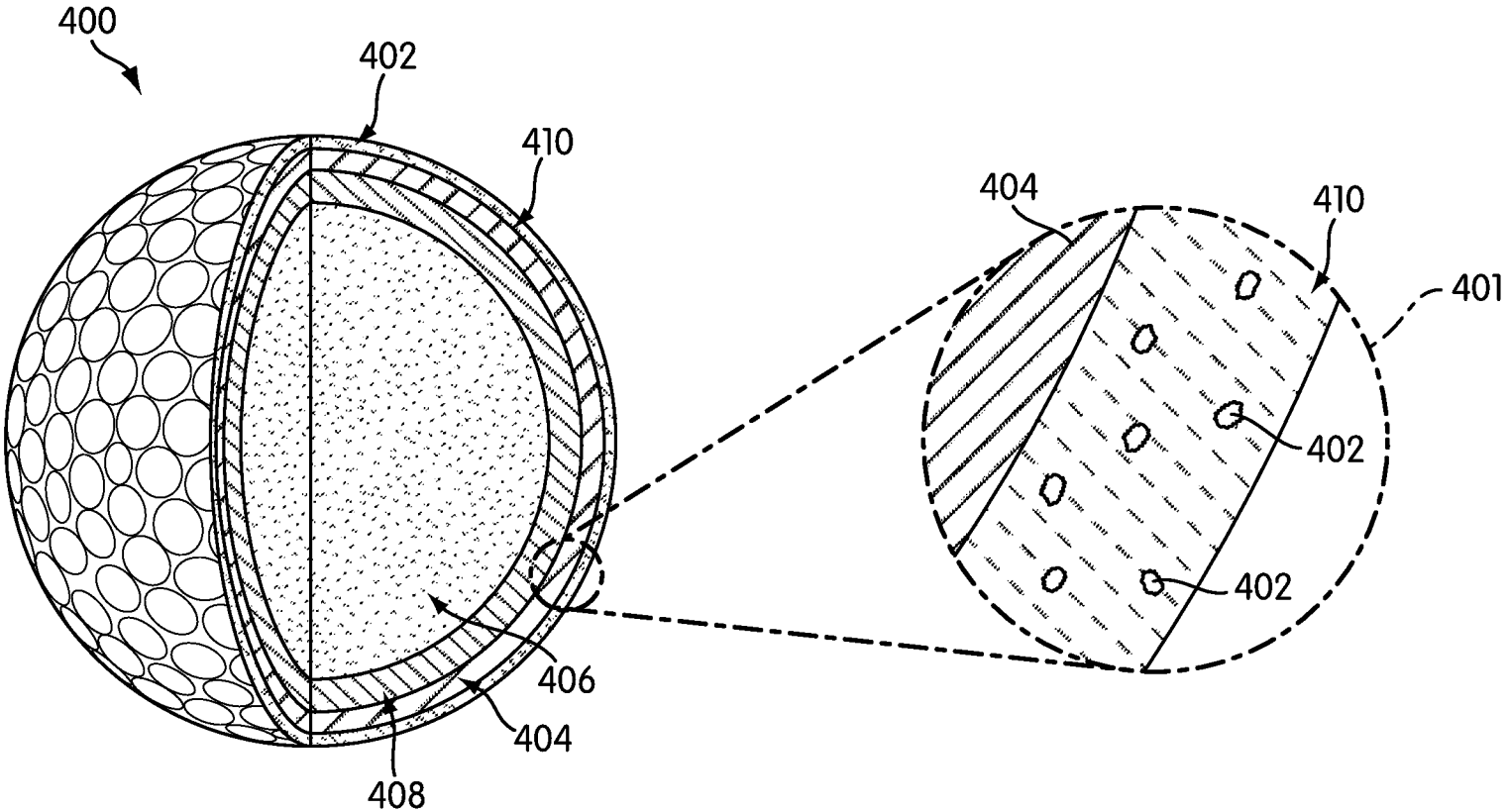
FIG. 4 shows an embodiment of a three-piece golf ball having a coating layer that includes carbon dioxide absorbents.

FIG. 4 shows a fourth embodiment of a golf ball in accordance with this disclosure. Golf ball 400 includes core 406, intermediate layer 408 substantially surrounding core 406, cover layer 404 substantially surrounding intermediate layer 408, and coating layer 410 substantially surrounding cover layer 404. In some embodiments, coating layer 410 may be adjacent to cover layer 404.

As shown in FIG. 4, coating layer 410 may include carbon dioxide absorbent particles 402. In other embodiments not shown, golf balls including one or more coating layers may include carbon dioxide absorbent particles in any of its several layers, or any combination or sub-combination thereof. For example, in one embodiment, a golf ball may include carbon dioxide absorbent particles in both its cover layer and coating layer.

In the particular embodiment shown in FIG. 4, carbon dioxide absorbent particles 402 are dispersed in coating layer 410. In other words, carbon dioxide absorbent particles 402 are dispersed in a polymer matrix, where the polymer matrix corresponds to coating layer 410.

Coating layers are generally known in the art of golf ball manufacturing. Coating layers may include, for example, clear coating, paint coating, sealant layers, or other thin marking layers that are located on top of the cover layer. Coating layer 410 may generally have a thickness of from about 10 μm to about 30 μm, or any intermediate point within that range.

In the embodiment shown in FIG. 4, coating layer 410 is a single layer that is disposed adjacent cover layer 404. Single layer coating layers may be composed of, for example, polyurethane. U.S. Pat. No. 5,461,109 to Blair et al. discloses a representative polyurethane single coating layer for golf balls. The disclosure of U.S. Pat. No. 5,461,109 to Blair et al. is hereby incorporated by reference in its entirety.

Figure 5:
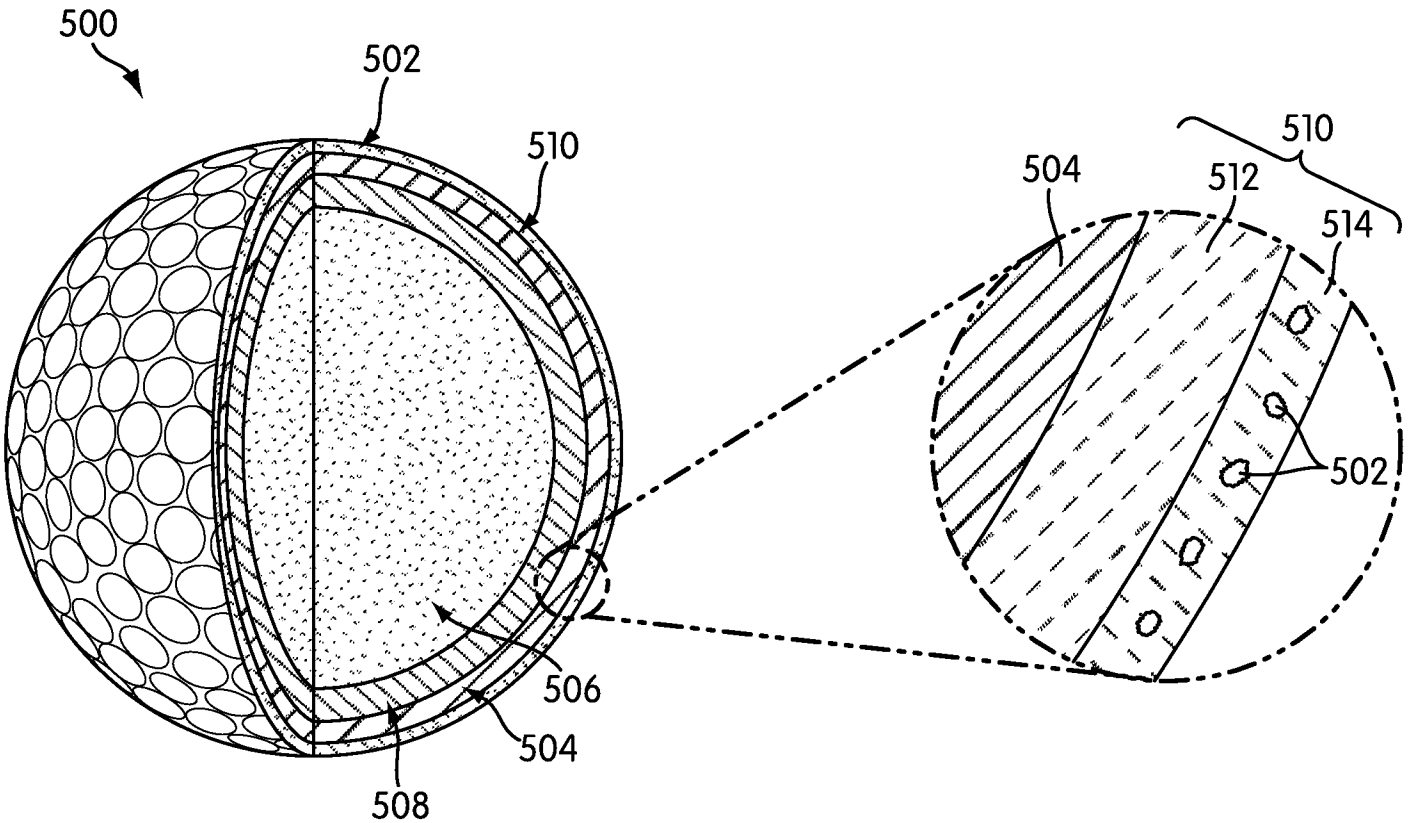
FIG. 5 shows a second embodiment of a three-piece golf ball having a coating layer that includes carbon dioxide absorbents.

Alternatively, a coating layer may include a primer layer. FIG. 5 shows an embodiment of a golf ball 500 that is largely similar to golf ball 400 above except with respect to coating layer 510. Golf ball 500 includes core 506, intermediate layer 508 substantially surrounding core 506, cover layer 504 substantially surrounding intermediate layer 508, and coating layer 510 substantially surrounding cover layer 504. However, unlike coating layer 410 in FIG. 4, coating layer 510 is made up of primer layer 512 and top coat layer 514. Primer layer 512 may be used in order to increase adhesion between cover layer 504 and top coating layer 514, as is generally known in the art of golf ball manufacturing.

In the embodiment shown in FIG. 5, only top coat layer 514 includes carbon dioxide absorbent particles 502. However, in other embodiments that include coating layers made up of a primer layer and a top coat layer, any of the various layers of the golf ball may include carbon dioxide absorbent particles in any combination thereof. For example, in one embodiment, both primer layer 512 and top coat layer 514 may include carbon dioxide absorbent particles 502. In another embodiment, cover layer 504, primer layer 512 and top coat layer 514 may all include carbon dioxide absorbent particles 502. The presence or absence, and loading amount weight percentage, of carbon dioxide absorbent particles 502 in any particular layer may be determined as variously discussed above.

Throughout the above discussed embodiments of various golf balls, each of the plurality of carbon dioxide absorbent particles are directly dispersed into a polymer matrix that corresponds to a structural layer of the golf ball. However, in such embodiments, the carbon dioxide absorbent particles may begin to absorb carbon dioxide immediately upon exposure to the atmosphere. This effect may decrease the amount of carbon dioxide that is absorbed by the golf ball during use, and may even saturate the carbon dioxide absorbents so that no more carbon dioxide can be absorbed. As golfers may desire for their own act of playing golf to directly have a positive environmental impact, this may be less than preferred.

A first method for alleviating this problem may be to manufacture the golf balls under a low carbon dioxide environment, such as under inert gas. However, this approach may be cost prohibitive. Alternatively, or in addition, golf balls as discussed above may be packaged in air-tight packaging immediately after completion of their manufacture. Air-tight packaging may include shrink-wrapping, or sealed containers, for example.

The golf ball would then begin to absorb carbon dioxide from the atmosphere immediately upon being removed from the air-tight packaging, and would become saturated after a certain period of time. This period of time may depend on factors such as the loading weight percentage of carbon dioxide absorbent particles in the golf ball, environmental factors such as moisture level, the permeability of the polymer matrix into which the carbon dioxide absorbent particles are dispersed, and other factors.

Figure 6:
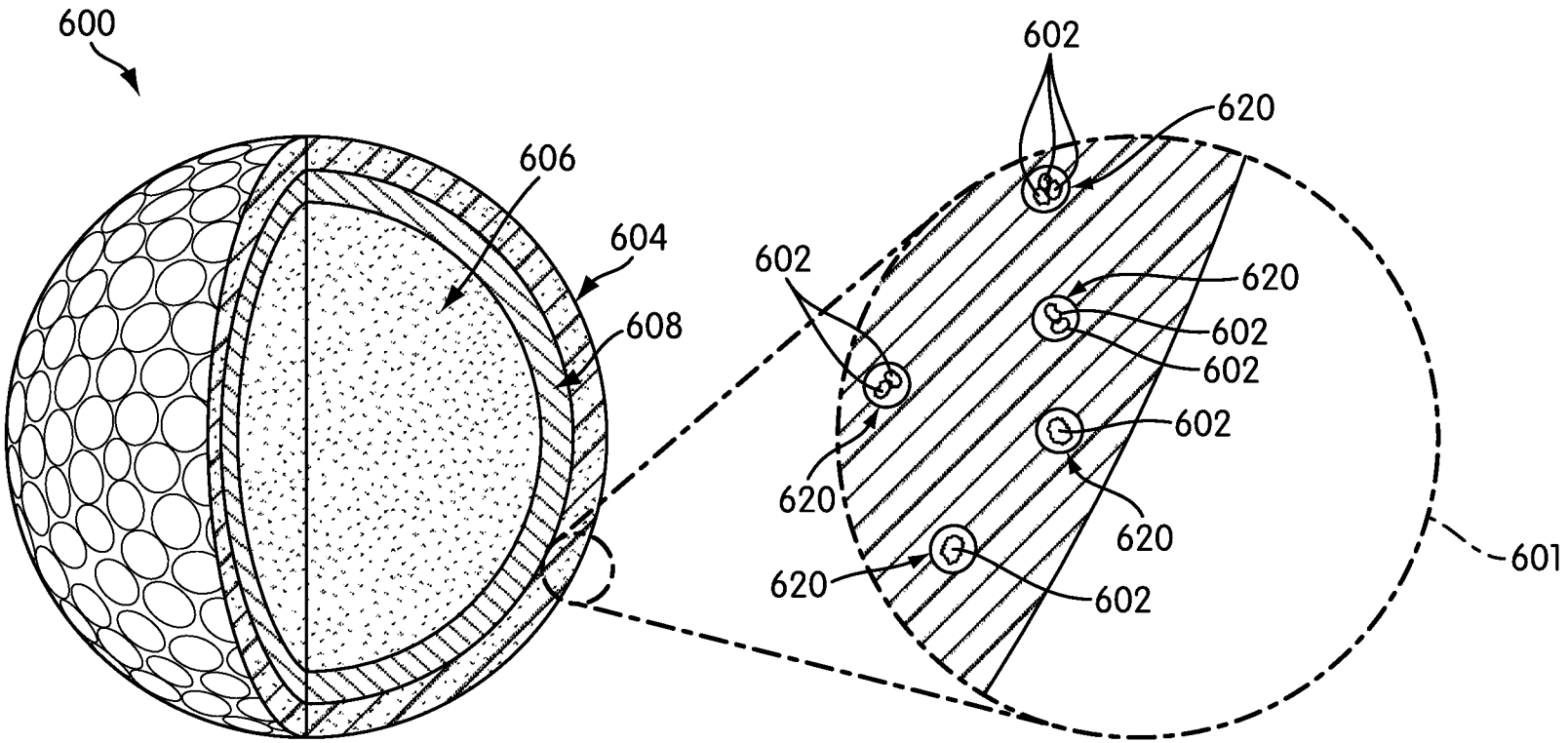
FIG. 6 shows an embodiment of a three-piece golf ball wherein the carbon dioxide absorbents are encapsulated.

One additional way of alleviating this problem, and linking the act of playing golf to a positive environmental impact, may be to encapsulate the carbon dioxide absorbent particles. FIG. 6 shows such an embodiment of a golf ball 600. Cover layer 604 may include carbon dioxide absorbent particles 602, and carbon dioxide absorbent particles 602 may be respectively encapsulated by at least one microcapsule 620. In the particular embodiment shown, carbon dioxide absorbent particles 602 are encapsulated by a plurality of microcapsules 620

The use of microcapsules in golf balls is disclosed generally in U.S. Patent Application Publication No. 2008/0085783 to Isogawa et al., the disclosure of which is hereby incorporated by reference in its entirety. Specifically, the microcapsules disclosed therein are frangible and contain a component that is only released upon rupture of the microcapsule due to the force of an impact between the golf ball and a golf club head face.

Microcapsules 620 may be dispersed in a polymer matrix, just as the various carbon dioxide absorbents discussed above may be dispersed in a polymer matrix. In the embodiment shown in FIG. 6, the polymer matrix corresponds to cover layer 604. However, in other embodiments, microcapsules 620 may be dispersed in any of the various layers of a golf ball, separately or in combination. For example, microcapsules 620 may be dispersed in a core, an intermediate layer, or a coating layer instead of or in addition to being dispersed in a cover layer Microcapsules 620 containing carbon dioxide absorbent particles 602 may be present in the polymer matrix in an amount of from about 1% to about 30% by weight of the polymer matrix. In various embodiments, microcapsules 620 containing carbon dioxide absorbent particles 602 may be present in amount of from about 1% to about 20%, or from about 1% to about 10%, or from about 1% to about 5%, or any intermediate points within these ranges. Such weight ranges are measured by the total weight of the microcapsules including the carbon dioxide absorbents therein.

Microcapsules 620 may have a number average particle size of from about 0.5 μm to about 100 μm, or larger. In various embodiments, microcapsules 620 may have a number average particle size of from about 0.5 μm to about 50 μm, or from about 0.5 μm to about 10 μm, or from about 0.5 μm to about 5 μm, or any intermediate points within these ranges. However, in other embodiments the at least one microcapsule 620 may be larger in size, on the order of a millimeter or centimeter. For example, one such relatively larger microcapsule may be present in the center of the core.

In some embodiments, microcapsules 620 may be made of a material that is substantially impermeable to carbon dioxide gas. In such embodiments, the microcapsule may substantially or entirely prevent atmospheric carbon dioxide from reacting with the carbon dioxide absorbent particle 602 therein. Polymer materials that are substantially impermeable to carbon dioxide gas are well known in the art of polymer chemistry, and include materials such as polypropylene or polyethylene terephthalate. U.S. Pat. No. 6,042,638 to Mallow et al., the disclosure of which is hereby incorporated by reference in its entirety, discloses a variety of binder materials that are substantially impermeable to carbon dioxide gas.

In other embodiments, microcapsules 620 may be made of a material that is only at least partially impermeable to carbon dioxide gas. U.S. Pat. No. 6,042,638 to Mallow et al. also discloses such materials. In these embodiments, as a result of being encapsulated inside of microcapsules 620, the rate at which atmospheric carbon dioxide is able to react with carbon dioxide absorbent particles 602 is at least partially reduced, and may be significantly reduced.

Therefore, in any of the various embodiments mentioned directly above, the rate at which carbon dioxide may react with carbon dioxide absorbent particles 602 is at least partially reduced as a result of carbon dioxide absorbent particles 602 being encapsulated within microcapsules 620. In particular embodiments, this rate is substantially zero.

However, this rate may be increased as a result of golf ball 600 being used by a golfer to play a round of golf. For example, in some embodiments, microcapsules 620 may be breakable. Due to being breakable, at least some of the plurality of microcapsules 620 may break open to expose the carbon dioxide absorbent particle 602 therein as a result of a force applied by a golf club face to the golf ball during a drive.

Figure 7:
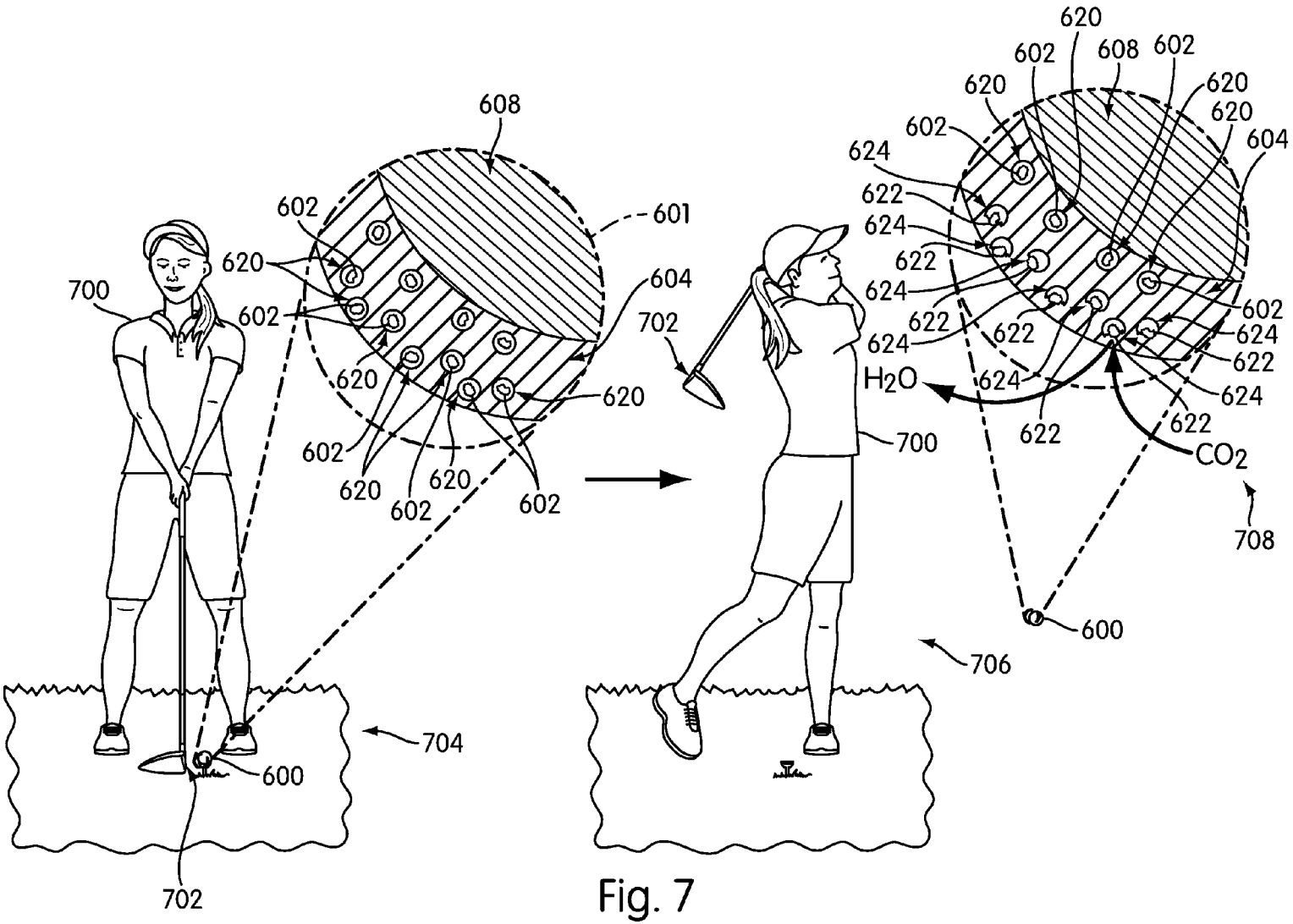
FIG. 7 shows a golfer striking the golf ball of FIG. 6 with a golf club during a drive.

FIG. 7 shows golf ball 600 in use. As shown in FIG. 7, golf ball 600 may be used during a drive. Golfer 700 prepares to drive golf ball 600 by striking golf ball 600 with golf club face 702 in state 704. In state 704, microcapsules 620 completely surround carbon dioxide absorbent particles 602. As a result, in state 704 prior to use, golf ball 600 may not absorb any significant amount of carbon dioxide from the atmosphere because microcapsules 620 may be substantially impermeable to carbon dioxide.

Yet FIG. 7 also shows, in state 706, what may happen to at least some of the plurality of microcapsules after golf ball 600 is struck by a golf club face 702 in a drive. In state 706, golfer 700 has completed her swing and golf ball 600 is driven down the fairway. As a result of the force applied by golf club face 702 to golf ball 600, at least some of microcapsules 624 may break open so as to expose some of the carbon dioxide absorbent particles 622. These particular carbon dioxide absorbent particles 622 may then proceed to react with atmospheric carbon dioxide as indicated by chemical pathway 708. Specifically, carbon dioxide gas is absorbed to form a metal salt and water.

As golfer 700 repeatedly drives golf ball 600 during a round of golf, more of the plurality of microcapsules 620 may break open. Thus, golf ball 600 may serve to reduce greenhouse gasses upon being used by golfer 700, and the act of playing game may be associated with the fight against global warming.

In an alternative embodiment not specifically shown in FIG. 7, the force applied to golf ball 600 by golf club face 702 may increase the rate of carbon dioxide absorbance by plastically deforming microcapsules 620 without breaking them when microcapsules are formed from a material that is only partially impermeable to carbon dioxide gas. As is generally known in the art of chemistry, the rate of diffusion of across a membrane is proportional to the total surface area of that membrane. Prior to use, microcapsules 620 may generally be spherical in shape, and thus have a relatively low surface area to volume ratio. However, as a result of being plastically deformed by the force applied by a golf club head during use, microcapsules may elongate and deform into a shape that has more surface area for the total volume therein. Accordingly, the rate at which carbon dioxide is able to pass through the microcapsule material and react with carbon dioxide absorbent particles therein may be increased.

This disclosure also provides the above discussed golf balls, where a golf ball achieves certain play characteristics. A golf ball in accordance with this disclosure may have a coefficient of restitution at a swing speed of forty meters per second of from about 0.73 to about 0.85. A golf ball may also have a deflection amount under a load of from about 10 to about 130 kilograms of from about 2.2 to about 4.0 millimeters.

When a golf ball in accordance with this disclosure includes a core (such as golf ball 200, golf ball 300, golf ball 400, golf ball 500, or golf ball 60) the innermost core layer may have a coefficient of restitution at a swing speed of forty meters per second of from about 0.77 to about 0.92.

A golf ball in accordance with this disclosure may also include a visual indicator that shows indicates to a golfer how much carbon dioxide has been absorbed. The visual indicator may be an indirect measure of the amount of carbon dioxide that has been absorbed.

For example, U.S. Patent Application Publication No. 2011/0177883, currently U.S. patent application Ser. No. 12/691,282, entitled Golf Ball Wear Indicator and filed on Jan. 21, 2010, the disclosure of which is hereby incorporated by reference in its entirety, discloses a golf ball wear indicator. The wear on a golf ball's outer layer(s) may be proportional to the number of times that the golf ball has been driven, which in turn may be proportional to the number of microcapsules that have broken open. Accordingly, the wear indicator may be an indirect visual indicator of the amount of carbon dioxide that has been absorbed by a golf ball in accordance with this disclosure.

As another example, a golf ball containing carbon dioxide absorbent particles may include a visual indicator in the form of a color changing ink. The chemical reaction between a carbon dioxide absorbent and atmospheric carbon dioxide may be exothermic, especially in embodiments where the carbon dioxide absorbent is a strong metallic hydroxide base. This exothermic reaction may release heat to a sufficient degree as to raise the local temperature of the polymer matrix in which the carbon dioxide absorbent particle is dispersed. The polymer matrix may therefore include a heat responsive color changing ink so as to act as a visual indicator of the carbon dioxide absorbance reaction.

U.S. Pat. No. 7,226,961 to Park et al. discloses golf balls including thermochromatic compounds that change color in response to heat. Other inks may be known to persons having ordinary skill in the art of thermochromatic compounds, and may be used in golf ball in accordance with this disclosure.

This disclosure also provides various methods of using the above discussed golf balls. Golf balls in accordance with this disclosure may generally be used in any known golfing activities, or other sporting or non-sporting related activities. Furthermore, golf balls in accordance with this disclosure may also be used in particular methods that encourage their use so as to encourage a positive effect on the environment.

FIGS. 8-11 show various embodiments of methods of use of golf balls in accordance with this disclosure. Generally, these methods provide an incentive or reward to a user that is commensurate with a positive environmental impact achieved by using the greenhouse gas reducing golf balls disclosed herein. While various embodiments are discussed below, it should be noted that any feature of a particular embodiment may be used in combination with any feature of any other embodiment, as may be desired.

A variety of methods are known in the golf industry that encourage certain behaviors. U.S. Patent Application Publication 2010/0056305 to Hebert et al., the disclosure of which is hereby incorporated in its entirety, discloses various distribution channels for collecting used golf balls and incentives for golfers to return used golf balls for recycling. Recycling golf balls may be environmentally friendly, but the methods described therein provide no additional positive environmental impact beyond the recycling of the golf ball itself.

Systems and methods for collecting, recycling and tracking golf balls are disclosed in U.S. Patent Application Publication No. 2012/0197812, currently U.S. patent application Ser. No. 13/018,007 to Yasushi Ichikawa et al., entitled "System and Method for Collecting, Recycling, Reusing and Tracking Golf Balls" and filed on Jan. 31, 2011, the disclosure of which is hereby incorporated by reference in its entirety. Generally, the methods disclosed in U.S. patent application Ser. No. 13/018,007 encourage a golfer to recycle golf balls by customizing the recycling process to the specific product being recycled.

In methods practiced in accordance with this disclosure, distribution channels such as those described in U.S. Patent Application Publication 2010/0056305 may be used, as may customization processes such as those described in U.S. patent application Ser. No. 13/018,007. However, in particular, methods in accordance with this disclosure tie an incentive given to a user to a degree of usage of a greenhouse gas reducing golf ball. A golfer may therefore be encouraged to use the particular greenhouse gas reducing golf balls discussed herein as opposed to other golf balls. Furthermore, the golfer may be encouraged to use the greenhouse gas reducing golf ball as much as reasonably feasible before replacing it, thereby promoting both reuse and recycling of the greenhouse gas reducing golf ball.

Figure 8:
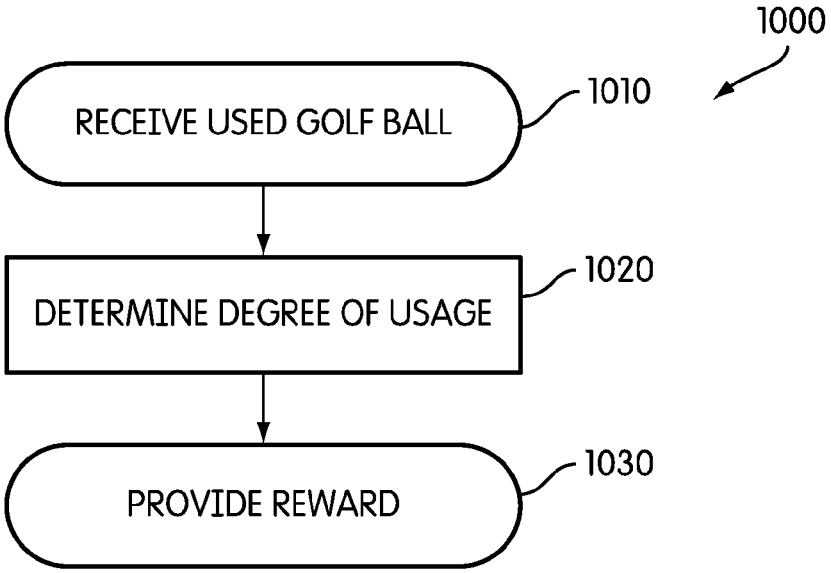
FIG. 8 shows a first embodiment of a method of encouraging a user to use a greenhouse gas reducing golf ball.

FIG. 8 shows one embodiment of a process for encouraging a user to use a greenhouse gas reducing golf ball. Method 1000 includes three general steps. A first step 1010 includes receiving a used greenhouse gas reducing golf ball from a user. As used herein, the phrase "greenhouse gas reducing golf ball" refers to golf balls in accordance with this disclosure, discussed above, that contain carbon dioxide absorbents. The particular greenhouse gas reducing golf ball may be any of the above discussed embodiments of golf balls that include carbon dioxide absorbents, or may be any golf ball including a carbon dioxide absorbent having any combination or sub-combination of features discussed herein above. Furthermore, the methods disclosed herein may also be used with respect to other golf balls, such as standard tournament play golf balls that do not reduce greenhouse gasses, or other golf balls.

As is generally known, a used golf ball is one that has been used in golfing activities to some non-negligible degree. Furthermore, as used herein, a "user" may be any natural person, organization or other entity. In particular embodiments, the user may be a golfer who personally engages in the sport of golf. However, in other embodiments, distribution channels such as are discussed in U.S. Patent Application Publication 2010/0056305 may be used, such that the used greenhouse gas reducing golf ball may be received from a user that is an organization such as a golf facility or a retail store.

The act of receiving may generally be any physical or electronic transference of a golf ball or information regarding the golf ball. For example, a golf ball may be physically transferred from the user to a second party, though distribution channels as disclosed in U.S. Patent Application Publication 2010/0056305. However, in other embodiments, the golf ball may experience only a small or negligible physical movement during the receiving step. For example, the golf ball may be placed into a kiosk by a user, such that the kiosk receives the golf ball from the user. Alternatively, one or more aspects of the golf ball may be digitized such as through scanning or photography. The digital representation of the golf ball may then be received by the party performing method step 1010 via electronic communications means such as a network.

Method 1000 next includes a second step 1020, wherein a degree of usage of the greenhouse gas reducing golf ball is determined. Generally, the degree of usage is a value that is indicative of whether, or how much, the golf ball has been used in golfing related activities. The degree of usage value may take any of a variety of formats. For example, in some embodiments, the degree of usage may be a binary value: either the golf ball has been used or has not been used. In other embodiments, the degree of usage may have any value on a continuous or step-wise scale. Specifically, the degree of usage may be a scalar integer value on a predetermined scale, such as a one to ten scale.

The degree of usage may be based on at least one physical property of the used greenhouse gas reducing golf ball. For example, U.S. Patent Application Publication No. 2011/0177883, currently U.S. patent application Ser. No. 12/691,282, entitled Golf Ball Wear Indicator discloses how various layers may be arranged on a golf ball such that scuffing causes a change in the visible color of the golf ball. In greenhouse gas reducing golf balls that include such wear indicators, the physical property that is used to determine the degree of usage may therefore be the color of the golf ball.

The color of the golf ball may also be used as a physical property to determine the degree of usage in embodiments of the greenhouse gas reducing golf ball that include thermochromatic compounds. As discussed above, the chemical reaction by which carbon dioxide is absorbed from the atmosphere is exothermic. This reaction may heat a heat responsive color changing compound in proportion to the amount of carbon dioxide absorbed. Thus, in embodiments of the greenhouse gas reducing golf ball where the reaction rate of carbon dioxide is proportional to usage, as discussed above and shown in FIG. 7, the change in color can thereby be used to determine the degree of usage.

Another physical property of the greenhouse gas reducing golf ball that may be used to determine the degree of usage may be the weight of the golf ball. As shown in Reaction (1), Reaction (2), and Reaction (3) above, the carbon dioxide absorption reaction generally forms a salt and water. This process increases the total weight of the golf ball, because the golf ball did not previously include the weight of the gaseous carbon dioxide that is absorbed and turned into the salt and water. Therefore, in embodiments of the greenhouse gas reducing golf ball where the reaction rate of carbon dioxide is proportional to usage, as discussed above and shown in FIG. 7, the weight of the golf ball may be used to determine the degree of usage. The weight may be measured "wet" including the water formed during the absorption process, or the weight may be measured "dry" after removing the water forming during the absorption process.

Further aspects of the step of determining the degree of usage as discussed below with respect to method 1200.

Finally, within method 1000, third step 1030 includes providing a reward to the user based on the degree of usage. The reward may generally be any incentive that a user might desire. For example, the reward may be selected from the group consisting of products, coupons, rebates, gift points, reward points, gift cards, credits, monetary awards, and combinations thereof. The format of the reward may follow the format of the degree of usage value. For example, in embodiments where the degree of usage value is a binary value, a fixed reward may either be provided or not. In contrast, in embodiments where the degree of usage value is a continuous value or integer value on a predetermined scale the value of the reward may be proportional to the degree of usage value. For example, when the degree of usage value is rated on a scale of one to ten, then the reward may have a value of from one to ten dollars respectively.

The reward may be provided to the user in any of a variety of means, such as through the postal mail, at a point of sale contact, or over a network. In particular embodiments, the reward may be communicated to the user via a network, such as over the Internet. In particular embodiments, the reward may be communicated to the user via a network such as through email, a static webpage, a dynamic webpage, an online social network, or combinations thereof.

Figure 9:
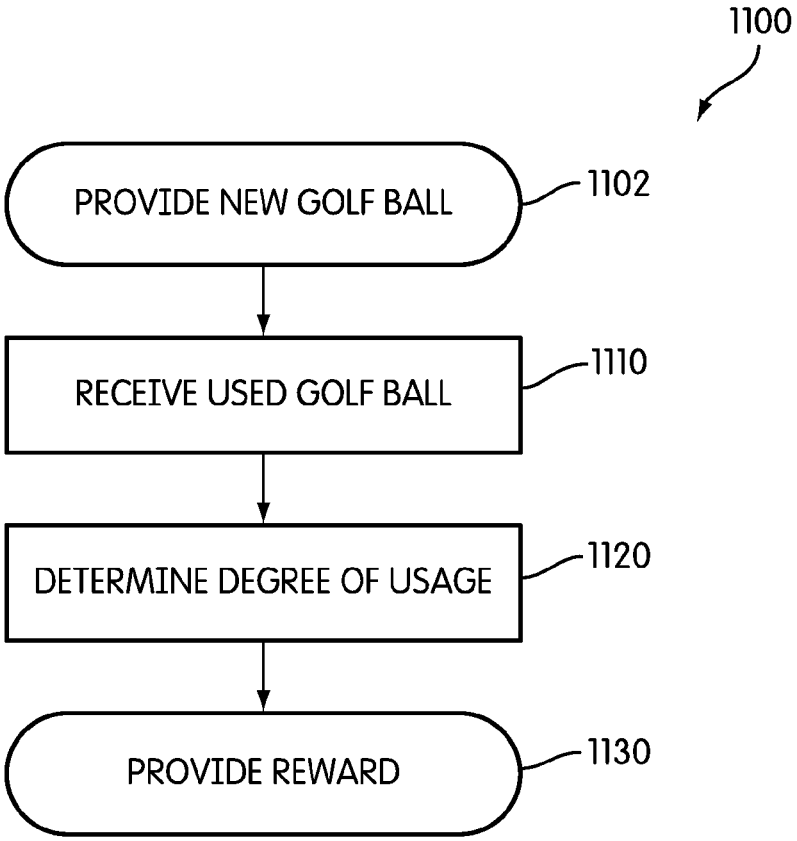
FIG. 9 shows a second embodiment of a method of encouraging a user to use a greenhouse gas reducing golf ball.

Further aspects of a step of providing a reward to a user are discussed below with respect to method 1100. FIG. 9 shows a second embodiment of a method of encouraging a user to use a greenhouse gas reducing golf ball. Method 1100 includes four steps. First step 1102 includes a preliminary step of providing a substantially new greenhouse gas reducing golf ball to a user. As is generally known, a golf ball is substantially new when it has not been used in golfing activities to any noticeable degree. The substantially new greenhouse gas reducing golf ball provided to the user in step 1102 corresponds to the same golf ball that may be received back from the user in second step 1110.

Method 1100 therefore encompasses both the forward distribution of the greenhouse gas reducing golf ball in first step 1102, and the reverse distribution of the greenhouse gas reducing golf ball after use in second step 1110. Forward distribution of the greenhouse gas reducing golf ball may occur by, for example, selling the golf ball to a golfer at a retail golf store. Various forward and reverse distribution channels are discussed in U.S. Patent Application Publication 2010/0056305. Reverse distribution step 1110 of receiving the used greenhouse gas reducing golf ball in method 1100 may be substantially similar to step 1010 in method 1000.

Method 1100 next includes step 1120 of determining the degree of usage. Step 1120 in method 1100 may be substantially similar to step 1020 in method 1000, as discussed above.

Finally, method 1100 includes step 1130 of providing a reward to the user. Step 1130 in method 1100 may be substantially similar to step 1030 in method 1000, as discussed above.

Figure 10:
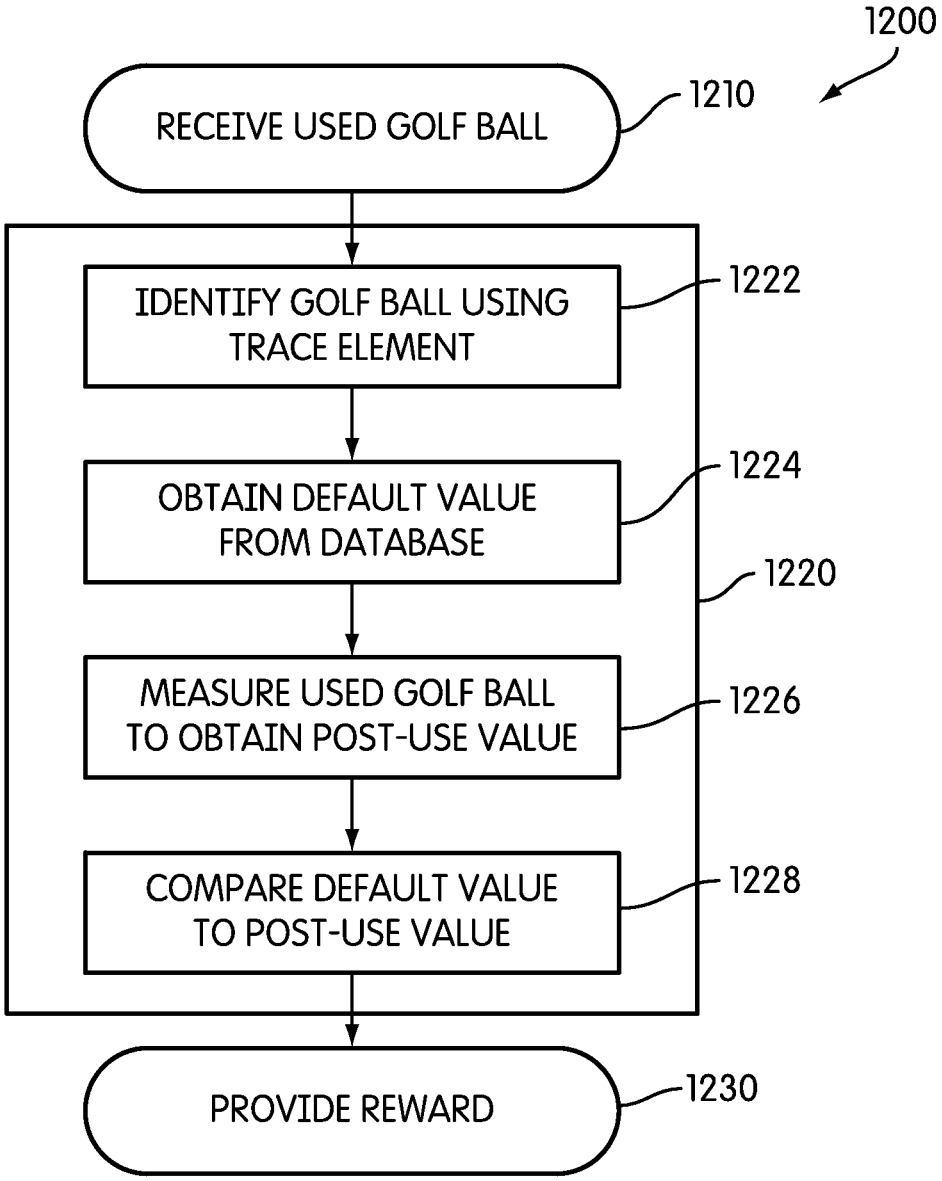
FIG. 10 shows a third embodiment of a method of encouraging a user to use a greenhouse gas reducing golf ball.

FIG. 10 shows a third embodiment of a method in accordance with this disclosure. Method 1200 includes three general steps. First step 1210 of receiving a used greenhouse gas reducing golf ball may be substantially similar to step 1010 in method 1000. Next, step 1220 includes several steps by which the degree of usage is determined.

Step 1220 includes first step 1222 of identifying the greenhouse gas reducing golf ball using a trace element in the golf ball. Trace elements are discussed in U.S. patent application Ser. No. 13/018,007. Generally, the trace element may be any marking or other communication medium that allows the golf ball to be identified. Examples of trace elements may include optical machine-readable representation of data such as a bar code, an RFID chip, or other machine translatable device applied to the golf ball. In particular embodiments, step 1222 may comprise identifying the used greenhouse gas reducing golf ball by comparing information associated with the trace element to information in a database, such as by using a simple matching algorithm. The specific identification may be, for example, identification of the model or type of greenhouse gas reducing golf ball, or identification of the specific individual greenhouse gas reducing golf ball.

Once the golf ball is identified using the trace element in step 1222, step 1220 may next include step 1224 of obtaining a default value of at least one physical property from the database. For example, if the physical property is color, then the database associated with the trace element may include information about a default value of the color of the golf ball. The default value may generally be the state of the physical property prior to use of the greenhouse gas reducing golf ball. The default value may therefore be predetermined at manufacture for any given type of greenhouse gas reducing golf ball, for example, or for the specific individual greenhouse gas reducing golf ball.

Next, in step 1226, the used greenhouse gas reducing golf ball is measured to obtain a post-use value of the at least one physical property. The measurement may be conducted in a manner appropriate to the physical property being measured, and may include multiple measurements that are (for example) averaged or otherwise sampled according to well-known measurement techniques. For example, if the at least one physical property is the weight of the used greenhouse gas reducing golf ball then the measurement in step 1226 may be a weighing using a scale. Alternatively, if the at least one physical property is the color of the used greenhouse gas reducing golf ball than the measurement in step 1226 may be a spectrophotometry measurement using a photometer, for example. Measurement of color may also take place, for example, using commonly available digital photography equipment, in conjunction with color analysis software.

In the final step 1228 within step 1220, the post-use value of the at least one physical property obtained in step 1226 may be compared to the default value obtained in step 1224. The value produced by this comparison may then be considered to be the degree of usage value. This comparison may be, for example, quantitative when the at least one physical property is expressed as a numeric value. Alternatively, in other embodiments, this comparison may be qualitative, such as a relative ranking. For example, if the physical property is weight then the comparison may consist in subtracting the default value from the post-use value to arrive at the change in weight. As another example, if the physical property is color, then the comparison may consist in finding a change in color based on a standard colorspace such as CIELAB.

In some embodiments, more than one physical property may be used to determine the degree of usage. In such embodiments, step 1224, step 1226, and step 1228 may be repeated for each physical property. For example, both weight and color may be used to determine the degree of usage. In such embodiments, step 1224 may include obtaining a default value for weight and a default value for color, step 1226 may include measuring the used greenhouse gas reducing golf ball for weight and for color, and then step 1228 may include comparing the post-use weight value to the default weight value and comparing the post-use color value to the default color value. A final step, not shown in FIG. 10, may then include creating a composite degree of usage value from the two (or more) comparison values.

Step 1230 in method 1200 of providing a reward to the user based on the degree of usage value may be substantially similar to step 1030 in method 1000 discussed above.

Figure 11:
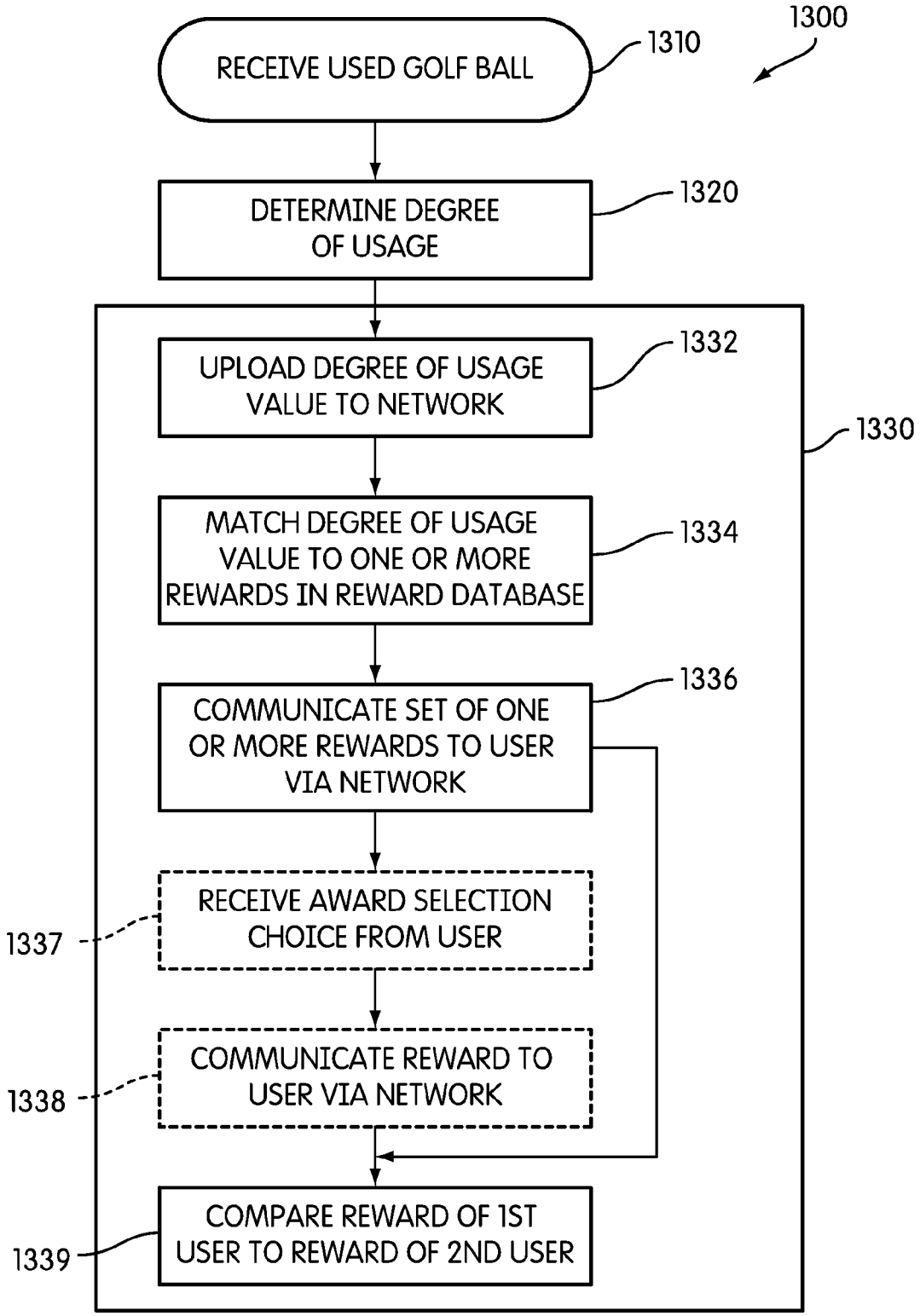
FIG. 11 shows a fourth embodiment of a method of encouraging a user to use a greenhouse gas reducing golf ball.

FIG. 11 shows a fourth embodiment of a method in accordance with this disclosure. Method 1300 includes first step 1310 of receiving a used greenhouse gas reducing golf ball. Step 1310 may be substantially similar to step 1010 in method 1000 discussed above. Method 1300 next includes second step 1320 of determining a degree of usage value. Step 1320 may be substantially similar to step 1020 in method 1000, or step 1220 in method 1200, discussed variously above.

Method 1300 also includes step 1330 of providing a reward to a user based on the degree of usage value. Step 1330 may include general characteristics of step 1030 in method 1000, in addition to the following details. Generally, step 1330 may be performed when the used greenhouse gas reducing golf ball is not physically proximate to the user at some particular step in process 1300. For example, step 1330 may be performed when the used greenhouse gas reducing golf ball is physically transferred to the entity performing method 1300 by reverse distribution channels, as discussed above. However, step 1330 or any step thereof may also be performed under other circumstances.

Step 1330 may include first step 1332 of uploading the degree of usage value to a network. The network may be an Internet enabled network, such as a webpage or social network. Step 1332 may be performed, for example, when the means for determining the degree of usage in step 1320 are separate from the means for providing the reward to the user.

Step 1330 next includes step 1334 of matching the degree of usage value to one or more rewards in a reward database associated with the network. Step 1334 may be performed when, for example, the entity performing method 1300 may desire to periodically change the particular reward (cash, coupon, etc.) offered to the user. Accordingly, the reward database may be changed to reflect (for example) user preferences regarding the type of reward, cross-promotion of a particular type of reward (e.g. a coupon for a newly released product), or promotions associated with a specific athletic event or athlete (e.g. a lottery to win tickets to a major sporting event).

Step 1336 next may include communicating a set of one or more rewards to the user via a network. As discussed above, the network may be an Internet enabled network such as a webpage or social network. Step 1336 may enable the user to receive the reward, for example, conveniently in the comfort of their home. Alternatively, step 1336 may enable the user to receive the reward at a preferred location associated with golfing, such as at the clubhouse of their favorite golf course.

Step 1330 also includes optional step 1337 and optional step 1338. As mentioned above, in step 1334 the degree of usage value may be matched to one or more rewards, and in step 1336 the entire set of one or more reward may be communicated to the user. In embodiments where this set includes two or more rewards, step 1337 may include receiving an award selection choice from the user. The award selection choice may include one or more of the two or more rewards in the set communicated to the user. For example, the set of two or more rewards may include different types of rewards such as cash, a coupon and a ticket to a sporting event. The user may then select one or more of these reward options as the user may desire. After the award selection choice is received in step 1337, the award itself may be communicated to the user in optional step 1338.

Step 1337 and step 1338 are optional because these steps may not be necessary when the set of one or more rewards communicated to the user in step 1336 includes only one reward. In such embodiments, the reward itself may be communicated to the user as part of step 1336.

Finally, step 1330 may include step 1339 of comparing the reward of a first user to the reward of a second user enable a competition among users. For example, in embodiments where the reward comprises "points", the point tally of one user may be numerically compared to the point tally of a second user. This comparison may take place across a network, such as an Internet enabled network like a webpage or social network. Such comparisons and competitions are discussed in U.S. patent application Ser. No. 13/018,007. Generally, such competitions between users may serve to further encouraging the use of greenhouse gas reducing golf balls, in addition to the reward itself, as golfers may have somewhat competitive personalities.

As a result of the methods describe variously above, users may be encouraged to have a positive environmental impact by using greenhouse gas reducing golf balls as opposed to other golf balls.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of calculating and providing a reward based on usage of a greenhouse gas reducing golf ball, the method comprising steps of:

(a) receiving pre-use data into a computer regarding a substantially new greenhouse gas reducing golf ball, the substantially new greenhouse gas reducing golf ball comprising a core;

an intermediate layer substantially surrounding the core, the intermediate layer being substantially impermeable to water;

a cover layer substantially surrounding the intermediate layer;

a carbon dioxide absorbent selected from the group consisting of alkaline hydroxides, alkaline oxides, alkali hydroxides, alkali oxides, and mixtures thereof;

the carbon dioxide absorbent being encapsulated within a plurality of microcapsules;

the plurality of microcapsules being frangible, such that at least one microcapsule of the plurality of microcapsules breaks as a result of a force applied by a golf club face to the greenhouse gas reducing golf ball during a drive, thereby exposing the carbon dioxide absorbent therein to atmospheric carbon dioxide;

the plurality of microcapsules being comprised of a material that is substantially impermeable to carbon dioxide;

the plurality of microcapsules being dispersed within a polymer matrix, the polymer matrix constituting a structural component of the greenhouse gas reducing golf ball;

(b) receiving post-use data into the computer regarding a used greenhouse gas reducing golf ball, the used greenhouse gas reducing golf ball corresponding to the substantially new greenhouse gas reducing golf ball after use;

(b) calculating with a computer processor a degree of usage value of the used greenhouse gas reducing golf ball by comparing the pre-use data with the post-use data, the pre-use data and post-use data being descriptive of at least one physical property of the used greenhouse gas reducing golf ball; and (c) calculating with the computer processor a reward based on the degree of usage value;

(d) providing the reward to a user.

2. The method of claim 1, wherein the step of: providing the reward comprises delivering a substantially new greenhouse gas reducing golf ball, the substantially new greenhouse gas reducing golf ball corresponding to the used greenhouse gas reducing golf ball prior to use.

3. The method of claim 1, wherein the at least one physical property used to calculate with a computer processor the degree of usage value is a color of the golf ball.

4. The method of claim 1, wherein the at least one physical property used to calculate with a computer processor the degree of usage value is a weight of the golf ball.

5. The method of claim 1, wherein the degree of usage value is a binary value.

6. The method of claim 1, wherein the degree of usage value is a scalar integer value on a predetermined scale.

7. The method of claim 1, further comprising a step of comparing with the computer processor a first reward given to a first user with a second reward given to a second user in order to enable a competition among users.

8. The method of claim 1, wherein the step of providing the reward to a user comprises communicating from the computer to a user the reward via a network.

9. The method of claim 1, wherein the step of providing the reward to a user comprises delivering to a user a reward selected from the group consisting of products, coupons, rebates, gift points, reward points, gift cards, credits, monetary rewards, and combinations thereof.

10. A method of using a computer to calculate a reward based on usage of a greenhouse gas reducing golf ball, the method comprising steps of:

(a) receiving data into a computer regarding a substantially new greenhouse gas reducing golf ball, the greenhouse gas reducing golf ball comprising a carbon dioxide absorbent selected from the group consisting of alkaline hydroxides, alkaline oxides, alkali hydroxides, alkali oxides, and mixtures thereof;

the carbon dioxide absorbent being dispersed within a polymer matrix, the polymer matrix constituting a structural component of the golf ball; and a trace element;

(b) receiving data into the computer regarding a used greenhouse gas reducing golf ball, the used greenhouse gas reducing golf ball corresponding to the substantially new greenhouse gas reducing golf ball after use;

(c) identifying the used greenhouse gas reducing golf ball by comparing with a computer processor information associated with the trace element to information in a computer database;

(d) obtaining a default data value of at least one physical property from the computer database;

(e) measuring the at least one physical property of the used greenhouse gas reducing golf ball to obtain a post-use data value of the at least one physical property;

(f) comparing the default data value to the post-use data value with the computer processor to output a degree of usage value; and (e) calculating with the computer processor a reward based on the degree of usage value.

11. The method of claim 10, wherein the carbon dioxide absorbent is selected from the group consisting of CaO, $Ca(OH)_2$, NaOH, LiOH, KOH, and mixtures thereof.

12. The method of claim 10, wherein the carbon dioxide absorbent is encapsulated within at least one microcapsule;

the at least one microcapsule being comprised of a material that is at least partially impermeable to carbon dioxide gas; and the at least one microcapsule being configured to plastically deform as a result of a force applied by a golf club face to the substantially new greenhouse gas reducing golf ball during a drive such that a rate at which carbon dioxide gas reacts with the carbon dioxide absorbent is increased; and the at least one microcapsule is dispersed within the polymer matrix.

13. The method of claim 10, wherein the carbon dioxide absorbent is encapsulated within at least one microcapsule;

the at least one microcapsule being comprised of a material that is substantially impermeable to carbon dioxide gas;

the at least one microcapsules being frangible, such that the at least one microcapsule breaks as a result of a force applied by a golf club face to the substantially new greenhouse gas reducing golf ball during a drive, thereby exposing the carbon dioxide absorbent therein to atmospheric carbon dioxide; and the at least one microcapsule is dispersed within the polymer matrix.

14. The method of claim 10, wherein the substantially new greenhouse gas reducing golf ball includes a thermochromatic compound.

15. The method of claim 10, wherein the substantially new greenhouse gas reducing golf ball includes:

a core;

an intermediate layer substantially surrounding the core, the intermediate layer being substantially impermeable to water; and a cover layer substantially surrounding the intermediate layer.

16. The method of claim 15, wherein the polymer matrix within which the carbon dioxide absorbent is dispersed corresponds to the cover layer.

17. The method of claim 15, wherein:

the substantially new greenhouse gas reducing golf ball further comprises a coating layer substantially surrounding the cover layer; and the polymer matrix within which the carbon dioxide absorbent is dispersed corresponds to the coating layer.

18. A method of using a computer to calculate a reward based on usage of a greenhouse gas reducing golf ball, the method comprising steps of:

(a) receiving data into a computer regarding a substantially new greenhouse gas reducing golf ball, the greenhouse gas reducing golf ball comprising a core;

an intermediate layer substantially surrounding the core, the intermediate layer being substantially impermeable to water;

a cover layer substantially surrounding the intermediate layer;

a carbon dioxide absorbent selected from the group consisting of alkaline hydroxides, alkaline oxides, alkali hydroxides, alkali oxides, and mixtures thereof;

the carbon dioxide absorbent being encapsulated within a plurality of microcapsules;

the plurality of microcapsules being frangible, such that at least one microcapsule of the plurality of microcapsules breaks as a result of a force applied by a golf club face to the greenhouse gas reducing golf ball during a drive, thereby exposing the carbon dioxide absorbent therein to atmospheric carbon dioxide;

the plurality of microcapsules being comprised of a material that is substantially impermeable to carbon dioxide;

the plurality of microcapsules being dispersed within a polymer matrix, the polymer matrix constituting a structural component of the greenhouse gas reducing golf ball;

a trace element;

(b) receiving data into the computer regarding a used greenhouse gas reducing golf ball, the used greenhouse gas reducing golf ball corresponding to the substantially new greenhouse gas reducing golf ball after use;

(c) identifying the used greenhouse gas reducing golf ball by comparing with a computer processor information associated with the trace element to information in a computer database;

(d) obtaining a default data value of at least one physical property from the computer database;

(e) measuring the at least one physical property of the used greenhouse gas reducing golf ball to obtain a post-use data value of the at least one physical property;

(f) comparing the default data value to the post-use data value with the computer processor to output a degree of usage value; and (g) calculating with the computer processor a reward based on the degree of usage value.

* * * * *